US006387016B1

(12) United States Patent
Lo

(10) Patent No.: US 6,387,016 B1
(45) Date of Patent: May 14, 2002

(54) WALKING EXERCISER HAVING A MECHANICALLY OPERATED TREADMILL BODY

(76) Inventor: Kun-Chuan Lo, No. 3, Ching-Cheng-Ssu St., Hsi Dist., Taichung City (TW)

( * ) Notice: Subject to any disclaimer, the term of this patent is extended or adjusted under 35 U.S.C. 154(b) by 0 days.

(21) Appl. No.: 09/752,124

(22) Filed: Dec. 29, 2000

(51) Int. Cl.[7] ..... A63B 22/02
(52) U.S. Cl. ..... 482/54; 482/51
(58) Field of Search ..... 482/51, 54

(56) References Cited

U.S. PATENT DOCUMENTS 5,626,538 A * 5/1997 Dalebout et al. ..... 482/54
6,110,076 A * 8/2000 Hurt ..... 482/54
6,135,925 A * 10/2000 Lin ..... 482/54

* cited by examiner

*Primary Examiner*—Glenn E. Richman
(74) *Attorney, Agent, or Firm*—Trop, Pruner & Hu, P.C.

(57) ABSTRACT

A walking exerciser includes a treadmill body, and a threaded rod which can be driven by a driving unit to extend from or withdraw into a movable tube. When the treadmill body is disposed at a horizontal position, the threaded rod is in a withdrawn position. Extension of the threaded rod turns the treadmill body from the horizontal position to a first inclined position, where a front section of the treadmill body is disposed higher than a rear section of the treadmill body. Withdrawal of the threaded rod relative to the tube turns the treadmill body from the first inclined position to a second inclined position, where the rear section of the treadmill body is disposed higher than the front section of the treadmill body. Then, the treadmill body can be turned to a vertical position by extending and subsequently withdrawing the threaded rod relative to the tube.

4 Claims, 12 Drawing Sheets

WALKING EXERCISER HAVING A MECHANICALLY OPERATED TREADMILL BODY

BACKGROUND OF THE INVENTION

1. Field of the Invention

The invention relates to a walking exerciser, more particularly to a walking exerciser that is provided with a mechanically operated treadmill body so as to facilitate folding and unfolding of the treadmill body with respect to a horizontal frame.

2. Description of the Related Art

Referring to FIG. 1, a conventional walking exerciser 10 is shown to include a base member 11 and an elongated treadmill body 12. The base member 11 includes a horizontal frame 110 with front and rear portions (111,112), a pair of upright posts 14,15 that are disposed on and that extend upwardly from the front portion 111 of the horizontal frame 110, and a handgrip member 16 attached to upper ends of the upright posts 14,15. The treadmill body 12 is laid over the base member 11, and has a front portion 121 connected pivotally to the front portion 111 of the horizontal frame 110 so that the treadmill body 12 can be turned upwardly on the base member 11 to a folded position, and a rear portion 122 that abuts against the handgrip member 16 when the treadmill body 12 is rotated to the folded position (not shown).

Some of the drawbacks of the aforesaid conventional walking exerciser are as follows:

1. Folding of the treadmill body 12 relative to the upright posts (14,15) of the base member 11 is done manually, thereby inconveniencing the user of the conventional walking exerciser.

2. At the folded position, the treadmill body 12 is only propped against the handgrip member 16. Thus, accidental collision to the treadmill body 12 may result in falling of the same over the horizontal frame 110, thereby exposing a nearby person to the risk of injury.

SUMMARY OF THE INVENTION

Therefore, the main object of this invention is to provide a walking exerciser with a mechanically operated treadmill body.

The secondary object of this invention is to provide a walking exerciser having a control device for controlling extension and retraction of a threaded rod relative to a tube so that alternate extension and retraction of the threaded rod results in folding of the treadmill body on an upright frame, thereby retaining the treadmill body securely at the folded position so that accidental falling of the treadmill body over a horizontal frame can be avoided.

Accordingly, the walking exerciser of the present invention includes a supporting member which has a horizontal frame with front and rear portions, and an upright frame that is disposed on and that extends uprightly from the horizontal frame, a treadmill body attached to and disposed over the rear portion of the horizontal frame and located at a horizontal position, an inclination adjustment mechanism, a control device, an elongated restricting element, a guiding member, and a projection. The inclination adjustment mechanism includes two rear links, two front links, two horizontal first pivots, a horizontal second pivot, a slide slot, a sliding roller unit, a connecting member, a movable tube, a threaded rod, and a drive unit. The rear links are secured to each other and are disposed at a horizontal position. Rear ends of the rear links are mounted pivotally on the rear portion of the horizontal frame. The first pivots extend through the front ends of the rear links, and are attached to the treadmill body, thereby connecting the rear links rotatably to the treadmill body. The front links are disposed in a horizontal position, and have front ends, and rear ends that are sleeved rotatably and respectively on the first pivots. The slide slot is formed in the supporting member, and extends rearwardly from the front portion of the horizontal frame to the rear portion of the horizontal frame. The sliding roller unit is mounted rotatably on one of the front ends of the front links, and is received slidably within the slide slot in the supporting member. The connecting member interconnects the front links fixedly. The movable tube has a first end that is connected pivotally to the connecting member, and a second end that has an end surface formed with a threaded hole in the tube. The threaded rod has a first end portion that engages threadedly the threaded hole in the tube, and a second end portion. The second pivot is disposed to extend in a direction parallel to the first pivots, and passes through the second end portion of the threaded rod for connecting the threaded rod rotatably to the treadmill body. The drive unit is disposed on one of the supporting member and the treadmill body, and is connected operably to the threaded rod for rotating the same to result in relative movement between the tube and the threaded rod. The control device controls actuation and stopping of the drive unit in a selected mode. The restricting element is disposed to extend longitudinally within the slide slot in the supporting member, and permits movement of the sliding roller unit thereon. The restricting element has a rear portion that is connected pivotally to the rear portion of the horizontal frame and that is formed with a rear positioning notch, and a front portion that is formed with a front positioning notch. The sliding roller unit is disposed in front of the front positioning notch in the restricting element. The guiding member is disposed fixedly on the horizontal frame, and is formed with an inclined limiting groove that has a closed upper end. The projection is attached to the front section of the treadmill body, and extends toward the guiding member.

The drive unit can be activated by the control device to move the tube away from the threaded rod so that the sliding roller unit moves rearward to a first position, where the sliding roller unit engages the first positioning notch in the restricting element and where the drive unit is stopped by the control device, thereby disposing the treadmill body at a first inclined position, where the front section of the treadmill body is disposed higher than the rear section of the treadmill body. When the treadmill body is disposed at the first inclined position, the drive unit can be activated by the control device to move the tube toward the threaded rod so that the rear section of the treadmill body turns upwardly about the second pivot to a second inclined position, where the rear section of the treadmill body is disposed higher than the front section of the treadmill body, where the projection slides into and is limited within the limiting groove, and where the drive unit is stopped by the control device. Subsequently, the drive unit is activated by the control device to move the tube away from the threaded rod so that the projection moves to the upper end of the limiting groove and so that the sliding roller unit moves rearward to a second position, where the sliding roller unit engages the rear positioning notch in the restricting element and where the drive unit is stopped by the control device. Thereafter, the drive unit is activated by the control device to move the tube toward the threaded rod so that the rear section of the treadmill body continues to turn upward about the second pivot to a vertical position, where the drive unit is stopped by the control device.

BRIEF DESCRIPTION OF THE DRAWINGS

These and other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
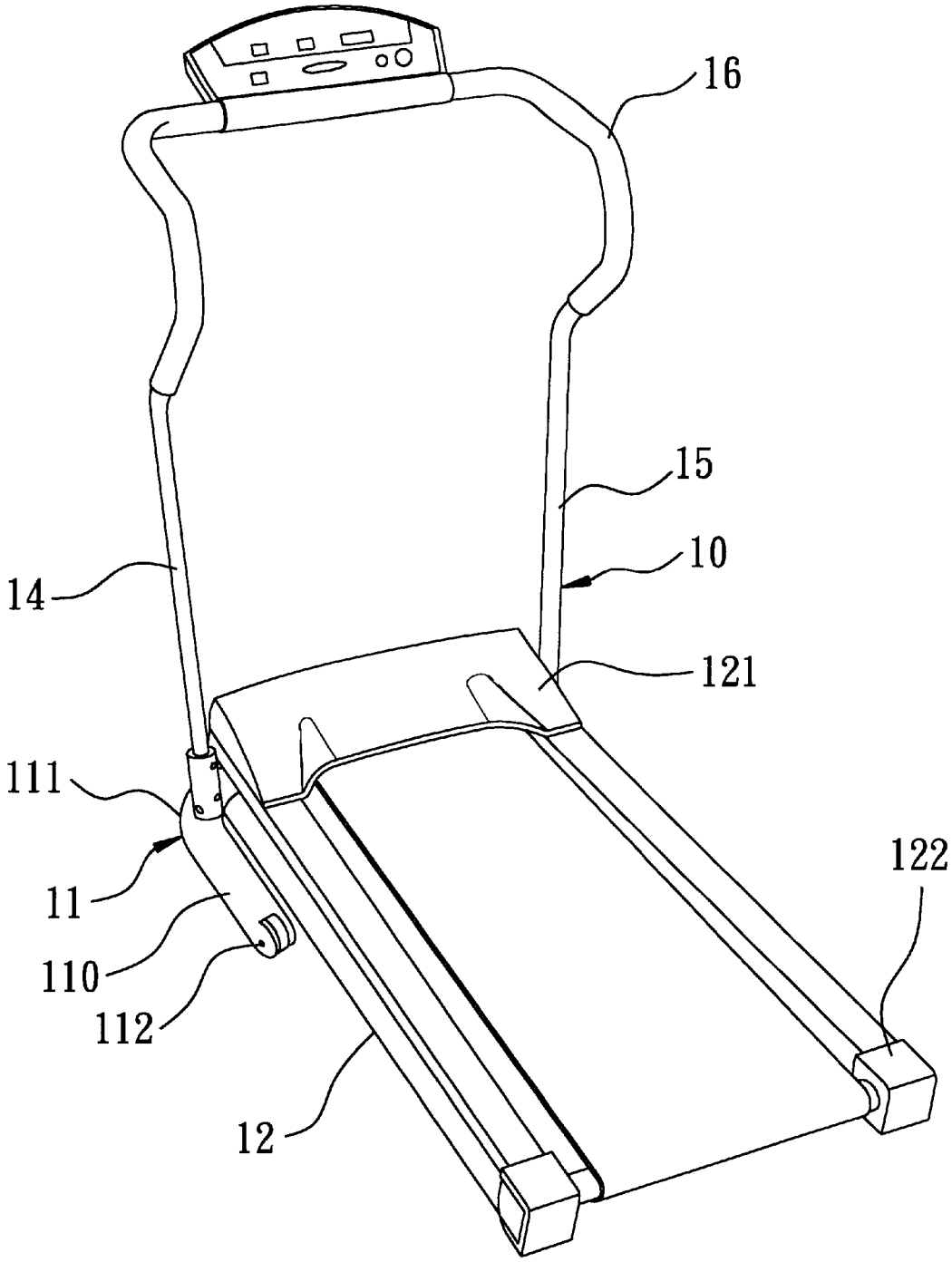
FIG. 1 PRIOR ART
FIG. 1 is a perspective view of a conventional walking exerciser.

Referring to FIGS. 2,3,4,5, 6 and 12, the preferred embodiment of a walking exerciser according to this invention is shown to include a supporting member, a treadmill body 40, an inclination adjustment mechanism 50, a control device 542, an elongated restricting element 60, a guiding member 70, and a projection 80.

As illustrated, the supporting member includes a horizontal frame 30 with front and rear portions 301,302, and an upright frame 90 which is disposed on and which extends uprightly from the front portion 301 of the horizontal frame 30.

The treadmill body 40 is attached to and is disposed horizontally over the rear portion 302 of the horizontal frame 30, and has a front section 401 and a rear section 402.

The inclination adjustment mechanism 50 includes two rear links 51, two front links 52, two horizontal first pivots 56, a slide slot 53, a sliding roller unit 523, a transverse connecting member 522 (see FIG. 7) a movable tube 552, a threaded rod 551, a horizontal second pivot 54, and a drive unit 541. The rear links 51 are disposed at a horizontal position, and have front ends 511, and rear ends 512 that are mounted pivotally on the rear portion 302 of the horizontal frame 30 by two pivots 311 (only one is visible in FIG. 3). The rear links 51 are secured to each other by a transverse connecting rod 515 (see FIG. 12). The first pivots 56 extend through the front ends 511 of the rear links 51, and is attached to the treadmill body 40 via a bracket 411 which is fixed on the treadmill body 40, thereby connecting the rear links 51 rotatably to the treadmill body 40. The front links 52 are disposed in a horizontal position, and have front ends 521, and rear ends 522 that are sleeved rotatably and respectively on the first pivots 56. The slide slot 53 is formed in a left side plate 32 (see FIG. 7) of the horizontal frame 30, and extends rearwardly from the front portion 301 of the horizontal frame 30 to the rear portion 302 of the horizontal frame 30. The sliding roller unit 523 is rotatably mounted on one end of a transverse connecting member 522 (see FIG. 7), which is rotatably mounted on a rectangular plate 525 (see FIG. 12) that interconnects the front ends 521 of the front links 52 fixedly such that the roller unit 523 is received slidably within the slide slot 53 in the left side plate 32 of the horizontal frame 30. The movable tube 552 has a first end that is connected pivotally to the rectangular plate 525 via a bracket 524 (see FIG. 12), and a second end that is formed with a threaded hole in the tube 552. The threaded rod 551 has a first end portion that engages threadedly the threaded hole in the tube 552, and a second end portion. The second pivot 54 is disposed to extend in a direction parallel to the first pivots 56, and passes through the second end portion of the threaded rod 551 so as to connect the same rotatably to the treadmill body 40. The drive unit 541 (see FIG. 12) is disposed on the treadmill body 40, and is further connected operably to the threaded rod 551 for rotating the same so as to result in relative axial movement between the tube 552 and the threaded rod 551. The restricting element 60 is disposed to extend longitudinally within the slide slot 53 in the horizontal frame 30, and permits movement of the sliding roller unit 523 thereon.

Figure 2:
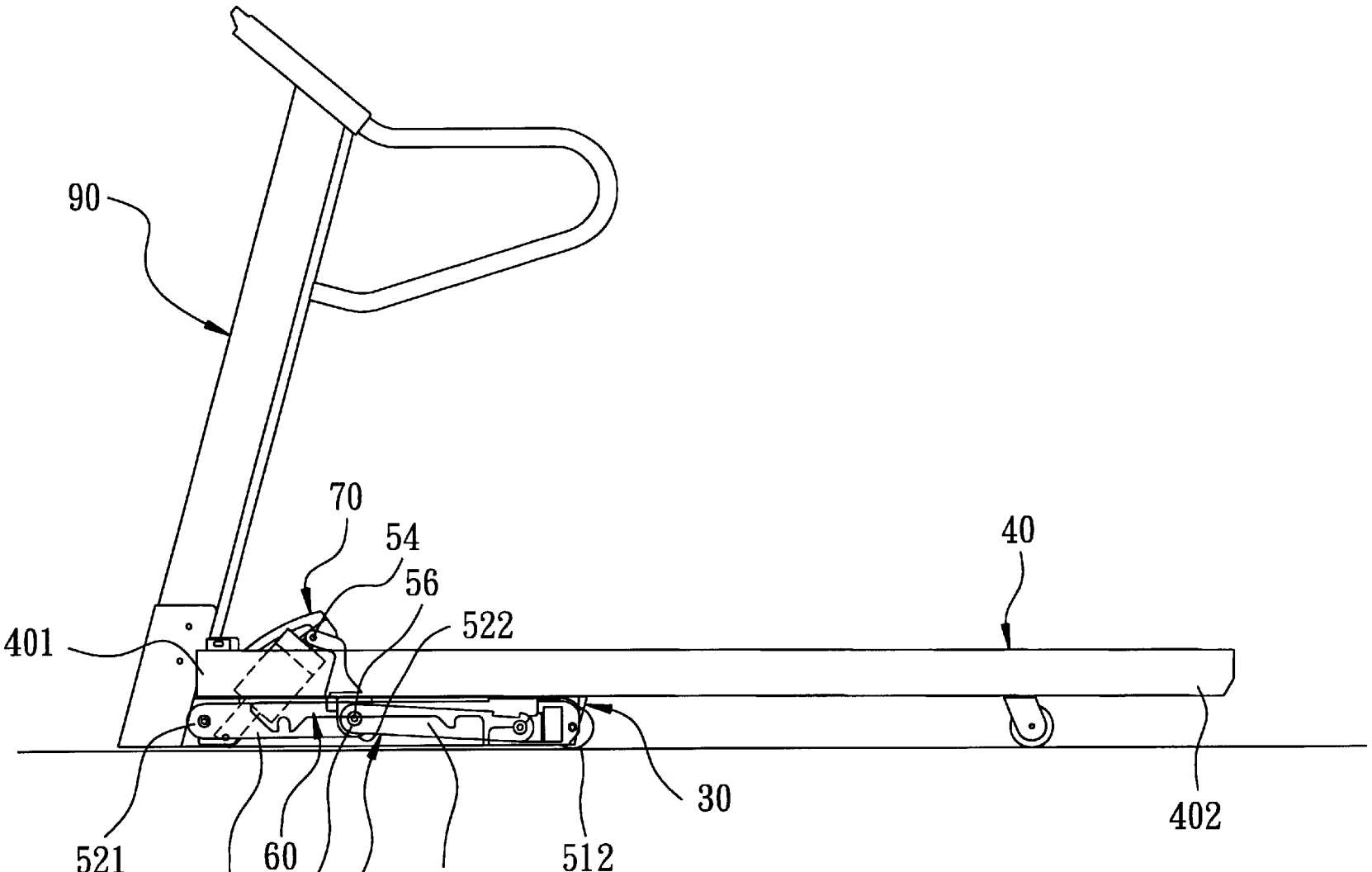
FIG. 2 is a schematic side view of a preferred embodiment of a walking exerciser according to the present invention at a normal position.
Figure 7:
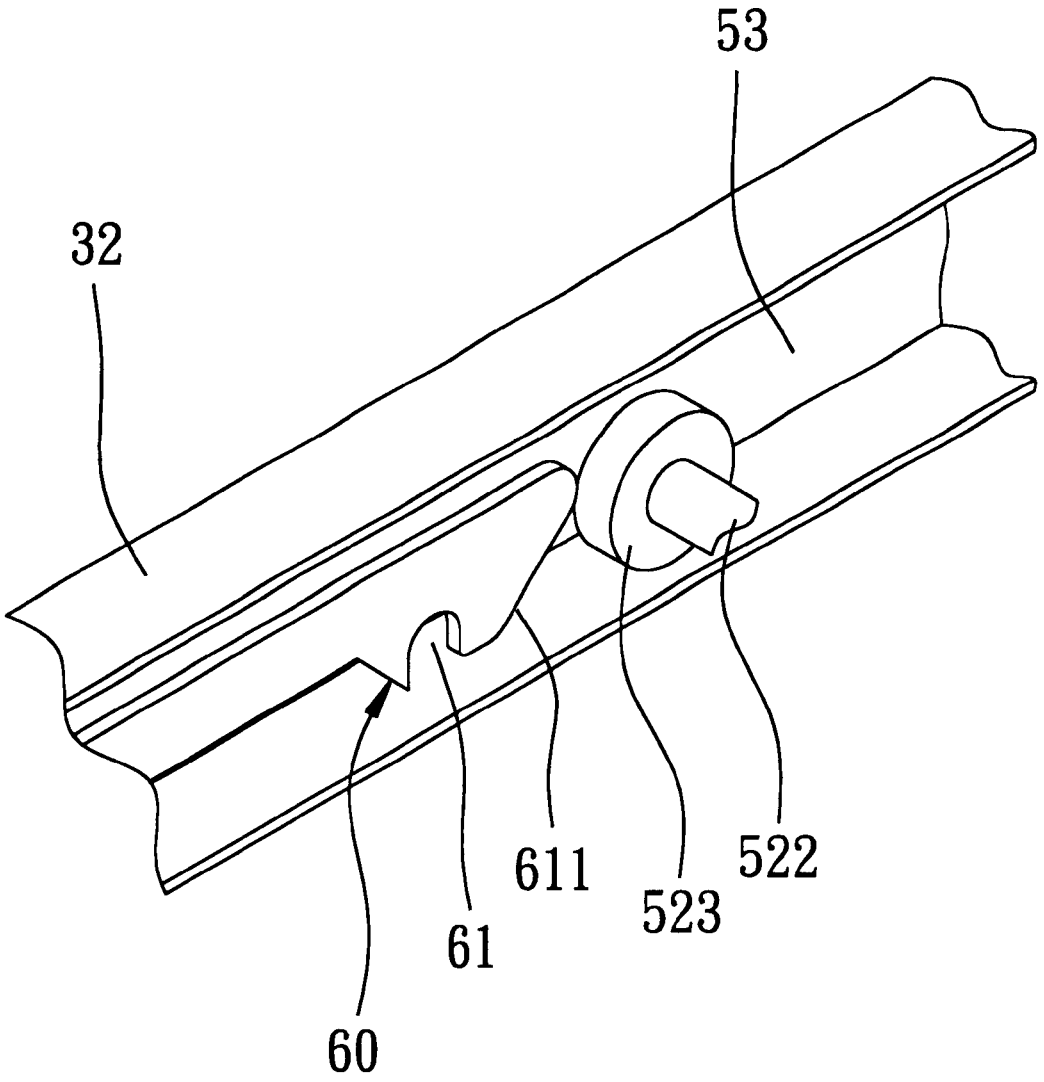
FIG. 7 is an enlarged and fragmentary view of the horizontal frame, illustrating relative position between the sliding roller unit and a restricting element disposed within the horizontal frame when the treadmill body is at the normal or horizontal position as shown in FIG. 2.
Figure 9:
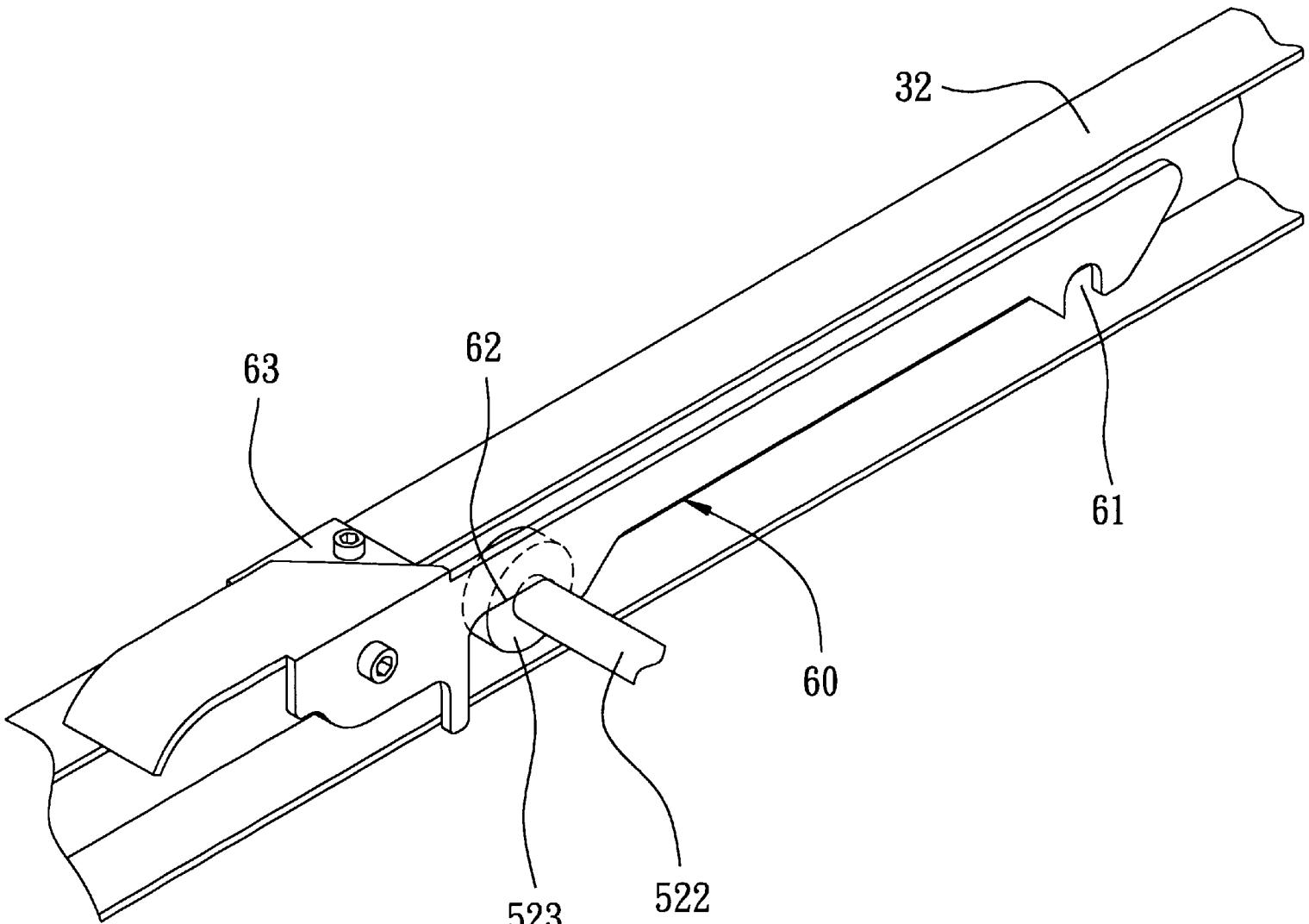
FIG. 9 is an enlarged and fragmentary view of the horizontal frame, illustrating relative position between the sliding roller unit and the restricting element when the treadmill body is at disposed vertically relative to the horizontal frame as shown in FIG. 6.

The restricting element 60, as best shown in FIG. 9, has a rear portion that is connected pivotally to the rear portion of the left side plate 32 via a bracket 63 and that is formed with a rear positioning notch 62, and a front portion that is formed with a front positioning notch 61. When the treadmill body 40 is disposed at the horizontal position, as shown in FIG. 2, the sliding roller unit 523 is located in front of the front positioning notch 61 in the restricting element 60, as best shown in FIG. 7.

The guiding member 70 is disposed fixedly on the front portion 301 of the horizontal frame 30, and is formed with an inclined limiting groove 74 (see FIGS. 5 and 10) that has an open lower end and a closed upper end.

The projection 80 is attached to the front section of the treadmill body 40, and extends toward the guiding member 70.

The control device 542 (see FIG. 12), such as aknown electronic sensor unit or a printed circuit unit, is mounted on the treadmill body 40 and is electrically coupled with the drive unit 541 so as to control the actuating and stopping of the drive unit 541.

The upright frame 90 is provided with a control panel (not shown) from which three positions of the treadmill body 40 can be selected to activate the control device 542. In particular, the treadmill body 40 can be turned to a selected one of horizontal, vertical and inclined positions by pressing one of three push buttons (not shown).

Figure 3:
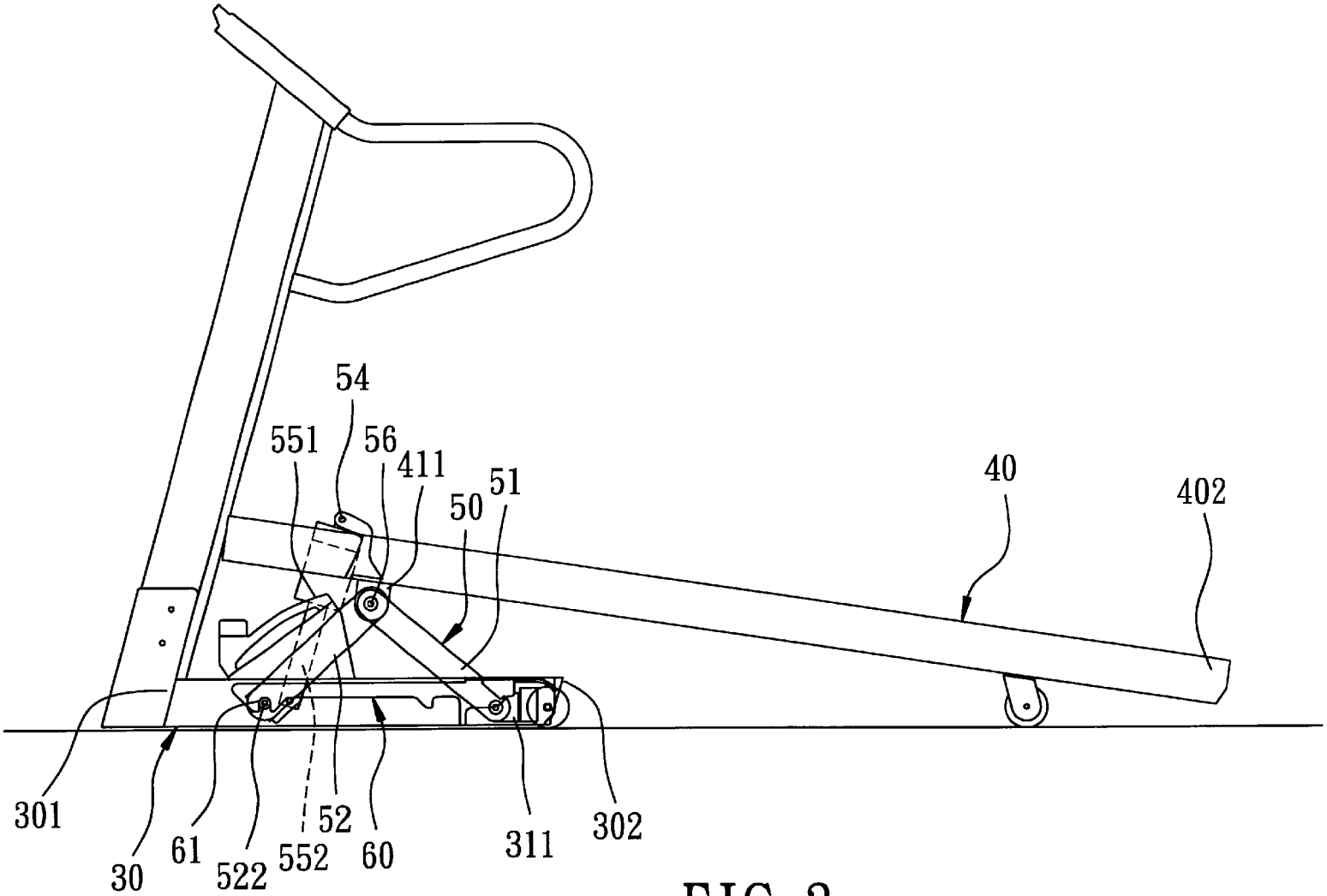
FIG. 3 is a schematic side view, illustrating a treadmill body of the preferred embodiment at a first inclined position, where a front section of the treadmill body is disposed higher than a rear section of the treadmill body.
Figure 8:
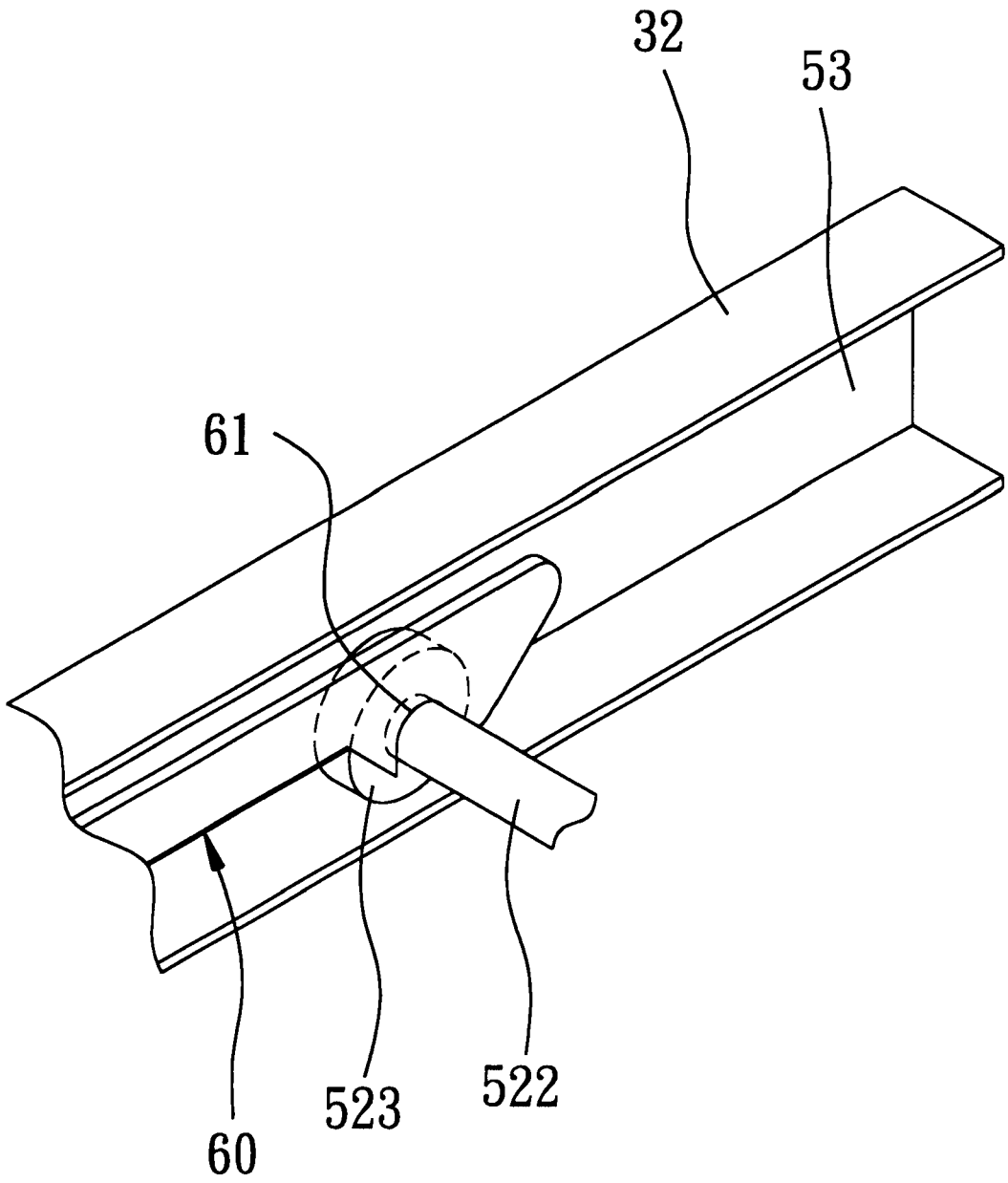
FIG. 8 is an enlarged and fragmentary view of the horizontal frame, illustrating relative position between the sliding roller unit and the restricting element when the treadmill body is at the first inclined position as shown in FIG. 3.

When the treadmill body 40 is disposed at the horizontal position as shown in FIG. 2, upon pressing a selected one of the push buttons, the drive unit 541 is actuated by the control device 542 to move the tube 552 away from the threaded rod 551 so that the sliding roller unit 523 moves rearward to a first position, where the sliding roller unit 523 engages the first positioning notch 61 in the restricting element 60 and where the drive unit 541 is stopped by the control device 542, thereby disposing the treadmill body 40 at a first inclined position, as best shown in FIG. 3, where the front section 401 of the treadmill body 40 is disposed higher than the rear section 402 of the treadmill body 40. Referring to FIGS. 7 and 8, the transverse connecting member 522 is cylindrical in cross section in the preferred embodiment, and can be arranged in such a manner to engage the first positioning notch 61 on behalf of the roller unit 523. The front end of the restricting element 60 is formed with an inclined surface 611 to facilitate sliding of the connecting member 522 into the first positioning notch 61.

Figure 4:
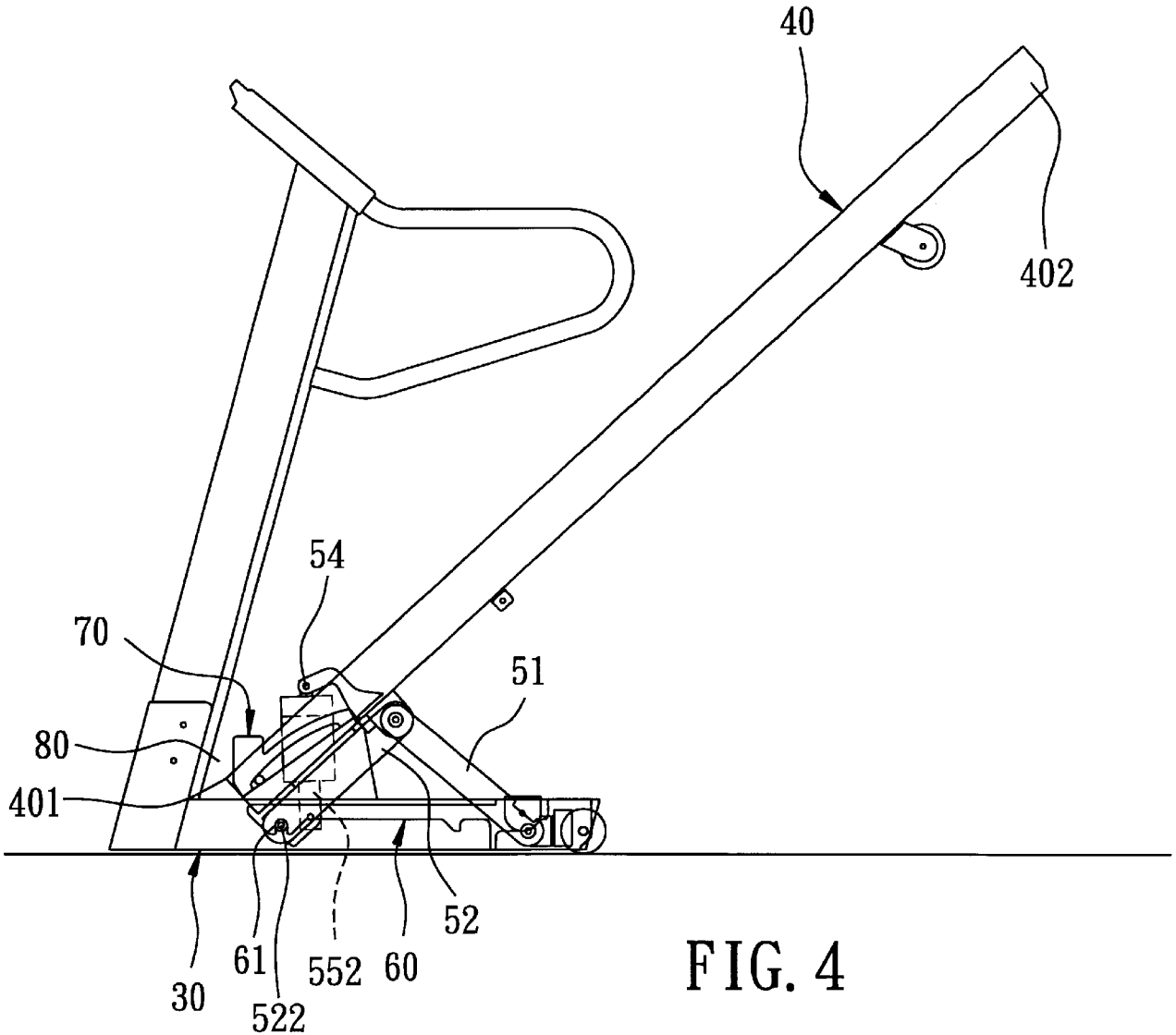
FIG. 4 is a schematic side view, illustrating the treadmill body of the preferred embodiment at a second inclined position, where the front section of the treadmill body is disposed lower than the rear section of the treadmill body.

When the treadmill body 40 is disposed at the first inclined position as best shown in FIG. 3, upon selecting the vertical position of the treadmill body 40 by operating the control panel, the drive unit 541 is activated by the control device 542 to move the tube 552 toward the threaded rod 551. At this condition, since the pivots 56,311 and the connecting member 522 are unable to move relative to one another, the rear section 402 of the treadmill body 40 turns upwardly about the second pivot 54 to a second inclined position, as shown in FIG. 4, where the rear section 402 of the treadmill body 40 is disposed higher than the front section 401 of the treadmill body 40, where the projection 80 slides into and is limited within the limiting groove 74 of the guiding member 70, and where the drive unit 541 is stopped by the control device 542.

Subsequently, the drive unit 541 is activated automatically by the control device 542 to move the tube 552 away from the threaded rod 551. Under this condition, since the projection 80 and the connecting member 522 are prevented by the limiting groove 74 and the first positioning notch 61 from moving in a vertical direction relative to the horizontal frame 30, the projection 80 moves rearwardly and inclinedly to the upper end of the limiting groove 74 while the connecting member 522 moves rearward to a second position, as shown in FIG. 5, where the connecting member 522 engages the rear positioning notch 62 in the restricting element 60 without altering the inclination of the treadmill body 40 relative to the horizontal frame 30, and where the drive unit 541 is stopped by the control device 542.

Figure 5:
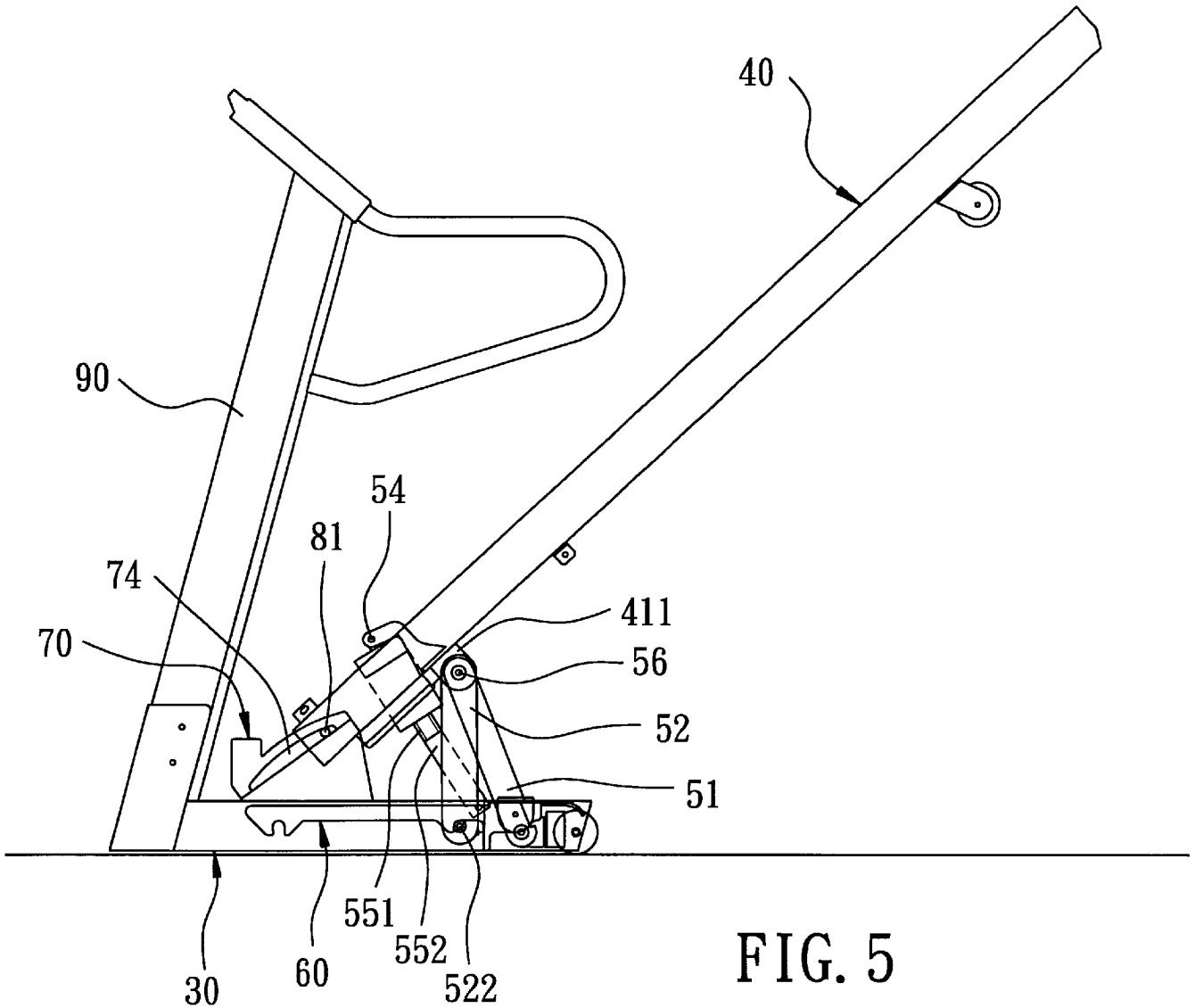
FIG. 5 is a schematic side view, illustrating how a slide roller unit disposed within a horizontal frame of the preferred embodiment is moved rearwardly due to interengagement between the treadmill body and a guiding member that is fixed on the horizontal frame.
Figure 6:
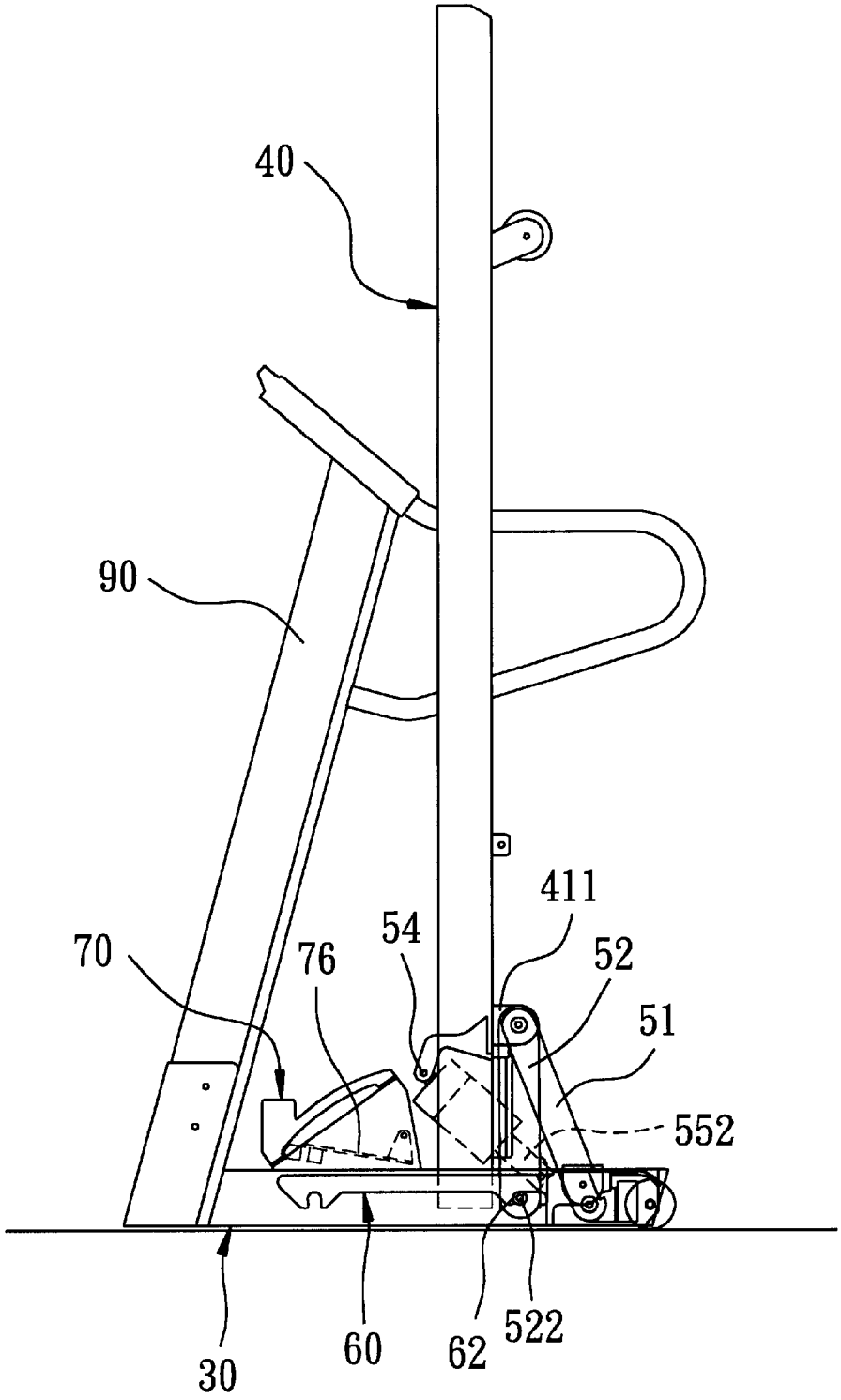
FIG. 6 is a schematic side view, illustrating how the treadmill body is folded perpendicularly on the horizontal frame of the preferred embodiment by virtue of idle rotation of the sliding roller unit at the rear portion of the horizontal frame.

When the treadmill body 40 is disposed at the second inclined position as shown in FIG. 5, the drive unit 541 is activated automatically by the control device 542 to move the tube 552 toward the threaded rod 551. Under this condition, since the pivots 56,311 and the connecting member 522 are unable to move relative to one another, the rear section 402 of the treadmill body 40 continues to turn upward about the second pivot 54 until reaching a vertical position relative to the horizontal frame 30, as best shown in FIG. 6, where the drive unit 541 is stopped by the control device 542.

Since the construction of the control device 542 and the control panel is not pertinent to the present invention, a detailed description of the same is omitted herein for the sake of brevity.

Figure 10:
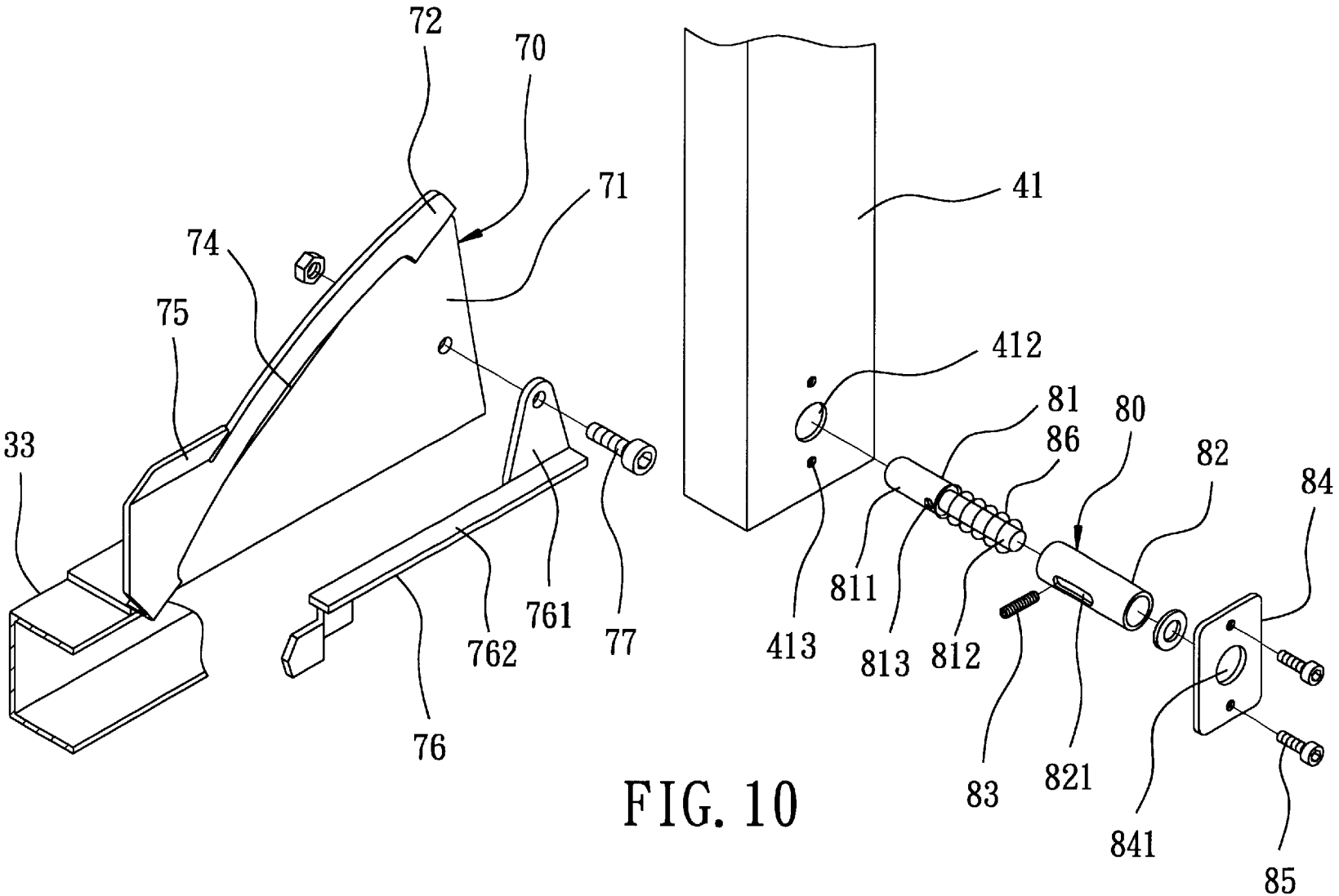
FIG. 10 is a fragmentary exploded view of the preferred embodiment, illustrating how a spring-loaded projection is mounted on the treadmill body for slidably engaging the guiding member that is fixed on the horizontal frame.

Referring to FIG. 10, the guiding member 70 has a vertical plate portion 71 fixed uprightly on a right side plate 33 of the horizontal frame 30, a curved plate portion 72 that is formed integrally on an upper end of the vertical plate portion 71 and that is formed with the limiting groove 74, and an inclined guiding plate portion 75 that is formed integrally on the vertical plate portion 71 for guiding the projection 80 into the limiting groove 74 when the treadmill body 40 is moved from the first inclined position of FIG. 3 to the second inclined position of FIG. 4. The treadmill body 40 includes a fixed right post 41 that is formed with a horizontal hole unit 412 therethrough. A horizontal mounting tube 82 is disposed within the hole unit 412 in the post 41, and is formed with a horizontal slot 821 that has two closed ends. Two fastener screws 85 extend through holes 842 in a mounting plate 84 and engage the threaded holes 413 in the right post 41 so as to confine the mounting tube 82 within the hole unit 412 in the right post 41. The projection 80 is shaped as a sliding rod 81 which extends through the hole unit 412 in the right post 41 and which has a large-diameter portion 811 that is sized to prevent insertion thereof into the hole 841 in the mounting plate 84, and a small-diameter portion 812 that extends through the hole 841 in the mounting plate 84. The large-diameter portion 811 of the sliding rod 81 is formed with a radial threaded hole 813. A sliding bolt 83 extends through the horizontal slot 821 in the mounting tube 82 and engages the threaded hole 813 in the large-diameter portion 811 of the sliding rod 81, thereby permitting movement of the sliding rod 81 within the mounting tube 82 while preventing removal of the sliding rod 81 from the mounting tube 82. A compression spring 86 is disposed within the mounting tube 82 around the small-diameter portion 812 of the sliding rod 81, and biases the sliding rod 81 to extend outwardly from the hole unit 412 in the post 41 to abut slidably against the guiding plate portion 75 of the guiding member 70.

Figure 11:
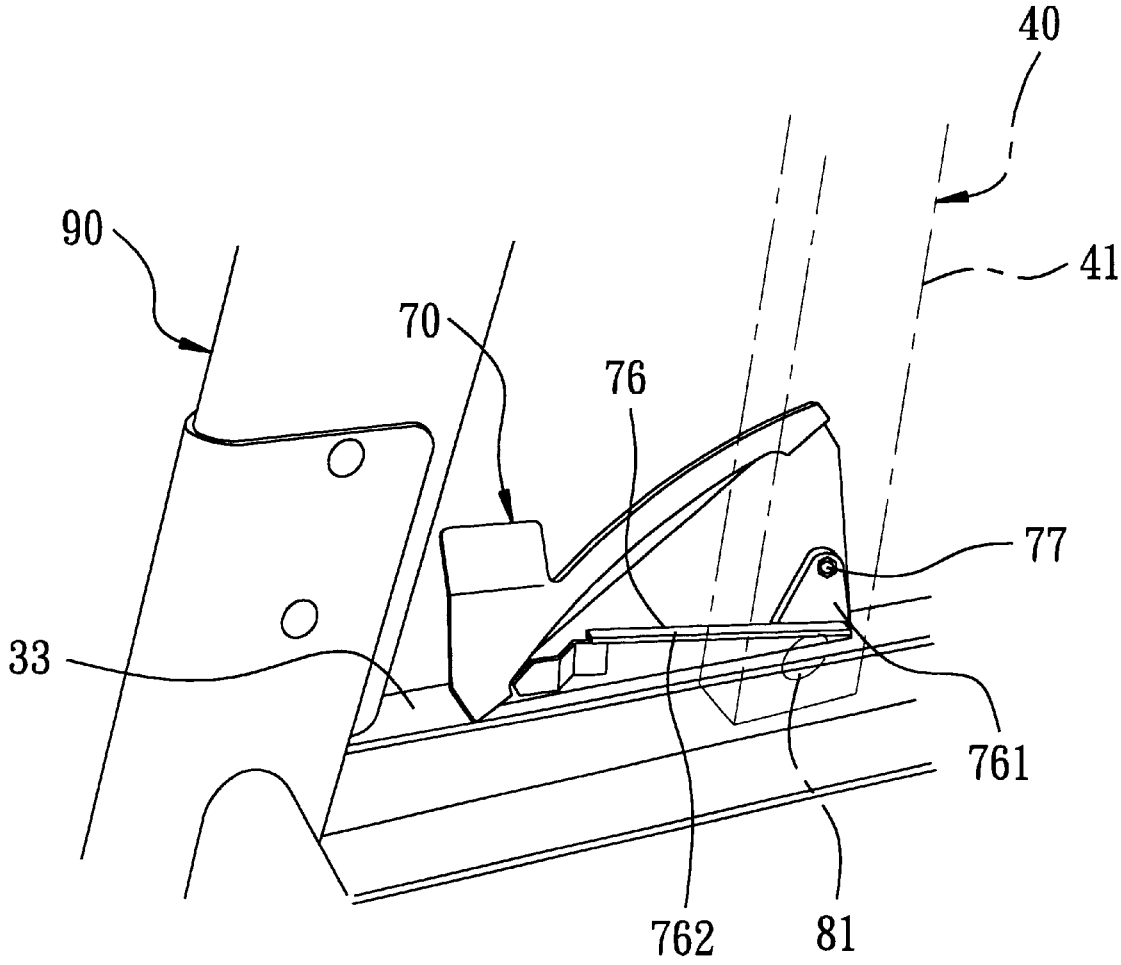
FIG. 11 is a fragmentary view of the preferred embodiment, illustrating how the spring-loaded projection is guided toward and away from the guiding member when the treadmill body is rotated between the horizontal position of FIG. 2 and the vertical position of FIG. 6.
Figure 12:
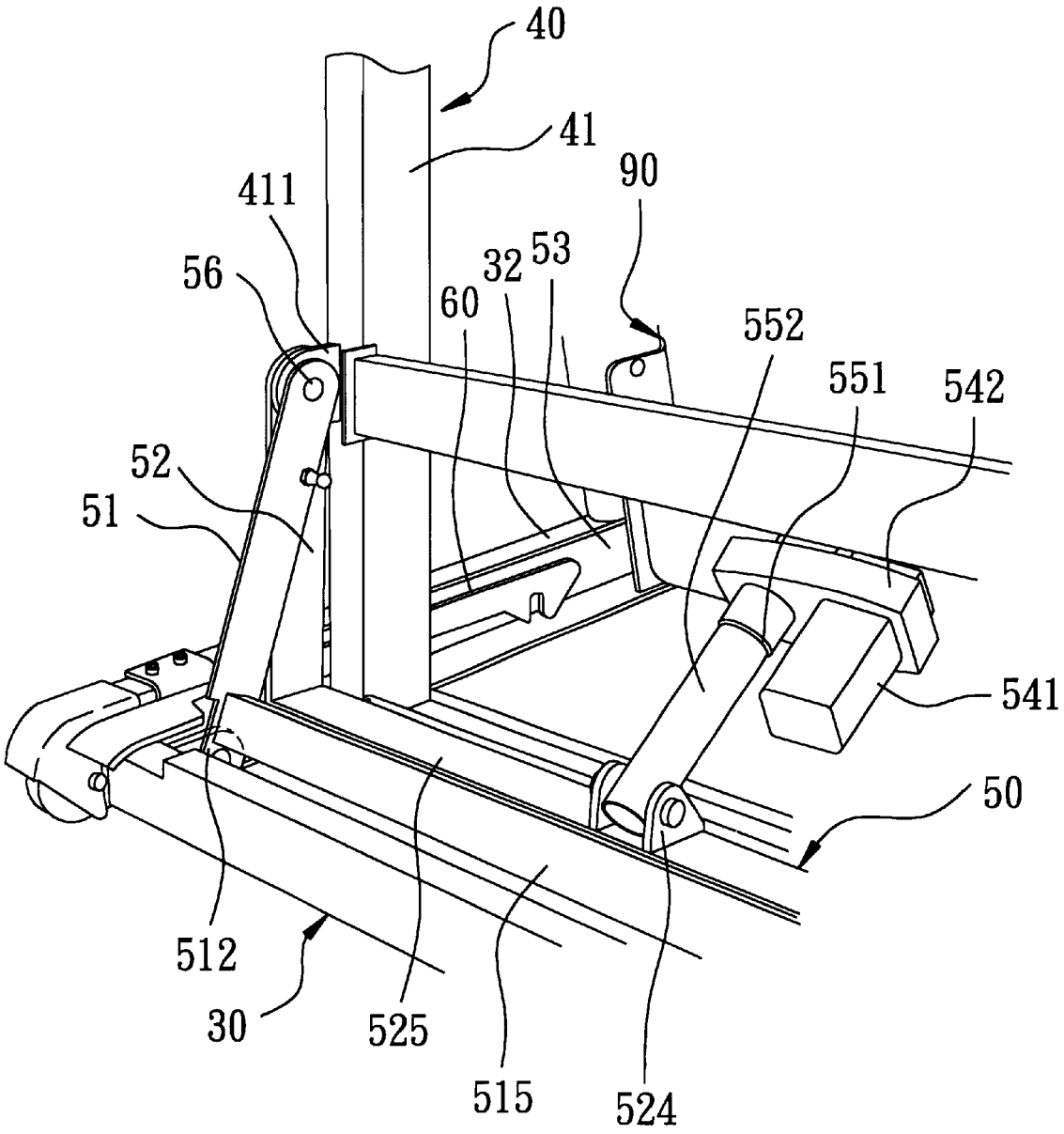
FIG. 12 is a fragmentary view of the preferred embodiment, illustrating an inclination adjustment mechanism that is disposed between the treadmill body and the horizontal frame.

As shown in FIG. 11, the guiding member 70 further includes an elongated projection-guiding rail 76 which is disposed below the limiting groove 74 and which has a rear part 761 mounted fixedly on the vertical plate portion 71 by a lock bolt 77, and a front part 762 extending forwardly from the rear part 761. The rail 76 slidably contacts the sliding rod 81 for guiding the sliding rod 81 toward the inclined guiding plate portion 75 when the treadmill body 40 rotates about the second pivot 56 so as to change its position from the vertical position of FIG. 6 to the first inclined position of FIG. 3.

Some of the advantages provided by the walking exerciser of the present invention are as follows:

1. Folding of the treadmill body 40 relative to the horizontal frame 30 is done mechanically and electronically, thereby facilitating the user of the present walking exerciser.

2. Since the treadmill body 40 can be retained securely at the first inclined, second inclined and vertical positions by virtue of the retracted and extended positions of the threaded rod 551 relative to the tube 552, injuries due to falling of the treadmill body 40 over the horizontal frame 30 can be avoided.

With this invention thus explained, it is apparent that numerous modifications and variations can be made without departing from the scope and spirit of this invention. It is therefore intended that this invention be limited only as indicated by the appended claims.

I claim:

1. A walking exerciser comprising:

a supporting member including a horizontal frame with front and rear portions, and an upright frame disposed on and extending uprightly from said front potion of said horizontal frame;

a treadmill body attached to and disposed over said rear portion of said horizontal frame and located at a horizontal position, said treadmill body having a front section and a rear section;

an inclination adjustment mechanism including two rear links which are disposed at a horizontal position and which have front ends, and rear ends that are mounted pivotally on said rear portion of said horizontal frame, said rear links being secured to each other, two horizontal first pivots extending through said front ends of said rear links and attached to said treadmill body, thereby connecting said rear links rotatably to said treadmill body, two front links which are disposed in a horizontal position and which have front ends, and rear ends that are sleeved rotatably and respectively on said horizontal first pivots, a slide slot formed in said supporting member and extending rearwardly from said front portion of said horizontal frame to said rear portion of said horizontal frame, a sliding roller unit rotatably mounted on one of said front ends of said front links and received slidably within said slide slot in said supporting member, a connecting member interconnecting said front links fixedly, a movable tube having a first end that is connected pivotally to said connecting member, and a second end which has an end surface that is formed with a threaded hole in said tube, a threaded rod which has a first end portion that engages threadedly said threaded hole in said tube, and a second end portion, a horizontal second pivot disposed to extend in a direction parallel to said first pivots, said second pivot passing through said second end portion of said threaded rod and connecting said threaded rod rotatably to said treadmill body, and a drive unit disposed on one of said supporting member and said treadmill body and connected operably to said threaded rod for rotating said threaded rod so as to result in relative axial movement between said tube and said threaded rod;

a control device for controlling actuation and stopping of said drive unit;

an elongated restricting element disposed to extend longitudinally within said slide slot in said supporting member and permitting movement of said sliding roller unit thereon, said restricting element having a rear portion that is connected pivotally to said rear portion of said horizontal frame and that is formed with a rear positioning notch, and a front portion that is formed with a front positioning notch, said sliding roller unit being disposed in front of said front positioning notch in said restricting element;

a guiding member disposed fixedly on said horizontal frame and formed with an inclined limiting groove that has a closed upper end; and a projection attached to said front section of said treadmill body and extending toward said guiding member, said drive unit being capable of being activated to move said tube away from said threaded rod so that said sliding roller unit moves rearward to a first position, where said sliding roller unit engages said first positioning notch in said restricting element and where said drive unit is stopped by said control device, thereby disposing said treadmill body at a first inclined position, where said front section of said treadmill body is disposed higher than said rear section of said treadmill body, said drive unit being capable of being actuated, when said treadmill body is disposed at said first inclined position, to move said tube toward said threaded rod so that said rear section of said treadmill body turns upwardly about said second pivot, thereby disposing said treadmill body at a second inclined position, where said rear section of said treadmill body is disposed higher than said front section of said treadmill body, where said projection slides into and is limited within said limiting groove, and where said drive unit is stopped and subsequently activated by said control device to move said tube away from said threaded rod so that said projection moves to said upper end of said limiting groove and so that said sliding roller unit moves rearward to a second position, where said sliding roller unit engages said rear positioning notch in said restricting element and where said drive unit is stopped and subsequently activated by said control device to move said tube toward said threaded rod so that said rear section of said treadmill body continues to turn upward about said second pivot to a vertical position, where said drive unit is stopped by said control device.

2. The walking exerciser as defined in claim 1, wherein said guiding member has a vertical plate portion, a curved plate portion that is formed integrally on said vertical plate portion and that is formed with said limiting groove, and an inclined guiding plate portion that is formed integrally on said vertical plate portion for guiding said projection into said limiting groove when said treadmill body is moved from said first inclined position to said second inclined position.

3. The walking exerciser as defined in claim 2, wherein said treadmill body includes:

a fixed post that is formed with a horizontal hole unit therethrough;

a horizontal mounting tube which is disposed within said hole unit and which is formed with a horizontal slot that has two closed ends;

a mounting plate bolted to said post so as to confine said mounting tube within said hole unit, and having a hole formed therethrough;

said projection being shaped as a sliding rod which extends through said hole unit and which has a large-diameter portion that is sized so as to prevent insertion thereof into said hole in said mounting plate, and a small-diameter portion that extends through said hole in said mounting plate, said large-diameter portion being formed with a radial threaded hole;

a sliding bolt extending through said horizontal slot in said mounting tube and engaging said threaded hole in said large-diameter portion of said projection, thereby permitting movement of said projection within said mounting tube while preventing removal of said projection from said mounting tube; and a spring disposed within said mounting tube and biasing said projection to extend outwardly from said hole unit of said post to abut slidably against said guiding member.

4. The walking exerciser as defined in claim 1, wherein said guiding member further includes an elongated projection-guiding rail mounted fixedly on said vertical plate portion below said limiting groove and in slidable contact with said projection for guiding said projection toward said inclined guiding plate portion when said treadmill body is moved from said vertical position to said first inclined position.

* * * * *